United States Patent [19]

Jurga

[11] Patent Number: 4,692,946

[45] Date of Patent: Sep. 15, 1987

[54] BASEBALL CATCHER'S LEG GUARD

[75] Inventor: Stanley M. Jurga, Shirley, Mass.

[73] Assignee: George Frost Company, Shirley, Mass.

[21] Appl. No.: 891,319

[22] Filed: Jul. 31, 1986

[51] Int. Cl.[4] ..... A41D 13/00

[52] U.S. Cl. ..... 2/22; 2/2

[58] Field of Search ..... 2/22, 2, 24; 128/80 C, 128/DIG. 15

[56] References Cited

U.S. PATENT DOCUMENTS

| | | | |
|---|---|---|---|
| 2,982,968 | 5/1961 | Groot | 2/22 |
| 4,484,360 | 11/1984 | Leighton et al. | 2/22 |
| 4,633,529 | 1/1987 | Litz | 2/22 |

*Primary Examiner*—Doris L. Troutman

*Attorney, Agent, or Firm*—Diller, Ramik & Wight

[57] ABSTRACT

A protective leg guard particularly adapted for baseball catchers is disclosed herein and includes a rigid foot guard, shin guard, knee guard and first and second thigh guards, each having secured thereto respective foot, shin, knee, first and second pads, elements pivoting the guards/pads for articulated relative movement, other elements including at least one strap looped about itself and sandwiched between the first thigh guard and first thigh pad and secured to the latter and to the knee guard and the second thigh guard to effect articulated motion therebetween, the shin pad including an upwardly projecting knee protection pad portion in spanning relationship to a gap between the knee guard and the shin guard, and the shin pad having opposite side edges and an ankle bone projection pad portion both of which project appreciably beyond opposite side edges and lowermost convex radius edges of the shin guard.

38 Claims, 5 Drawing Figures

BASEBALL CATCHER'S LEG GUARD

BACKGROUND OF THE INVENTION

The invention is directed to a protective leg guard, particularly of the type utilized by baseball catchers, and is specifically designed to provide ultimate protection and maximum articulation so that when utilized a catcher's mobility is not impeded while performing all aspects related to his position.

SUMMARY OF THE INVENTION

The invention is a novel protective leg guard, particularly designed for utilization by a baseball catcher and includes a relatively rigid foot guard, shin guard, knee guard and first and second thigh guards, each carrying respective foot, shin, knee, first and second thigh pads, means pivotally connecting the guards/pads to each other, and the first thigh guard being in generally exterior overlapping relationship to the knee guard and second thigh guard.

Still another object of this invention is to provide a novel protective leg guard as aforesaid wherein a pair of flexible straps are utilized to secure the knee, first and second thigh guards to each other, each strap being generally a closed loop, and rivets fixing portions of each closed loop to the knee, first and second thigh guards.

Still another object of this invention is to provide a novel protective leg guard of the type just described wherein the shin pad includes an upper convex edge defining a knee protective pad portion which projects into the area of the knee guard and spans a gap between the knee guard and an upper edge of the shin guard to provide ultimate protection in the upper shin-to-knee area.

Yet another object of this invention is to provide a novel protective leg guard in which the shin guard includes a center-line rib opening outwardly, a pair of transverse ribs to either side of the center-line rib also opening outwardly, the latter ribs collectively reinforcing the shin guard, and a strap spanning the interior of the shin guard in generally chordal relationship for preventing impact forces from an associated ball and/or bat from interiorly collapsing/cracking the normally transverse concave configuration of the shin guard.

Another object of this invention is to provide a novel protective leg guard as aforesaid wherein peripheral side edges and lowermost convex radial edges of an associated shin pad project appreciably beyond like edges of a shin guard to afford maximum protection to shin, calf and ankle bone areas of a person utilizing the protective leg guard.

Still another object of this invention is to provide a novel baseball catcher's protective leg guard as aforesaid wherein separate pieces of shock-absorbant material are precisely located between upper edge portions of the shin guard and shin pad to further assure maximum protection to the knee area and upper shin of a person using the leg guard.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
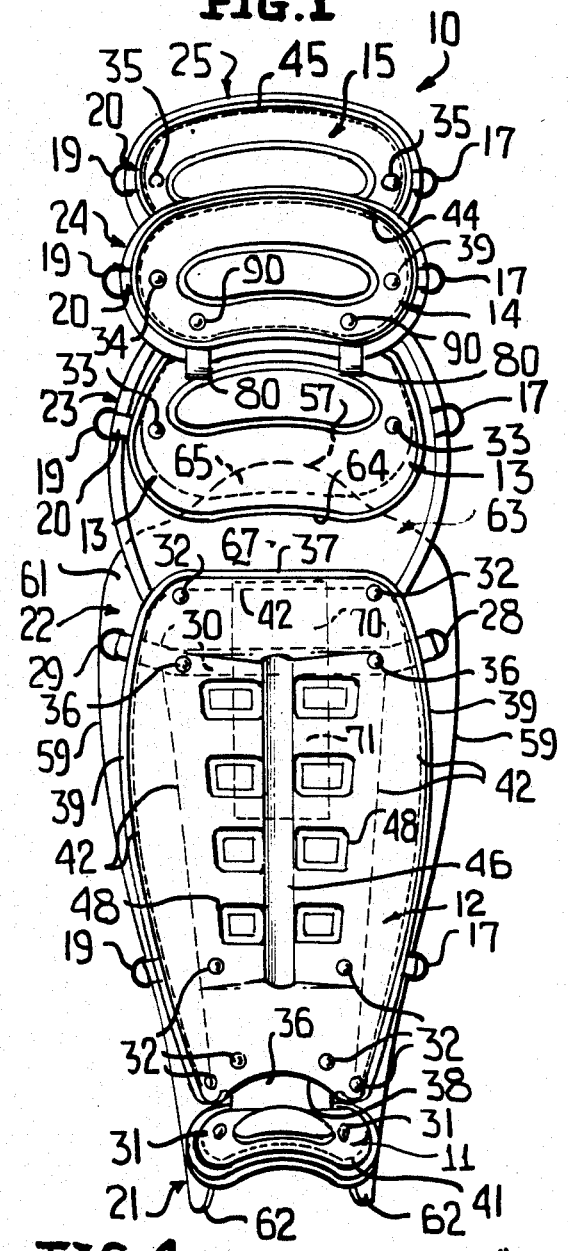
FIG. 1 is a front perspective view of a novel baseball catcher's protective leg guard, and illustrates from bottom-to-top relatively rigid foot, shin, knee, first and second thigh guards each carrying an associated pad and appropriate elements articularly/pivotally connecting the same to each other.

A novel protective leg guard constructed in accordance with this invention which is particularly adapted to be used by baseball catchers as generally designated by the reference numeral 10.

The protective leg guard 10 includes a toe guard 11, a shin guard 12, a knee guard 13, a first thigh guard 14, and a second thigh guard 15. The guards 11 through 15 are constructed from relatively rigid plastic material, such as high density polyethylene.

Each of the guards 11 through 15 carries upon an inner surface (unnumbered) a relatively soft foam plastic pad, namely, a toe pad 21, a shin pad 22, a knee pad 23, a first thigh pad 24 and a second thigh pad 25. The pads 21 through 25 are formed of expanded polyurethane or cross-link polyethylene or simply a soft rubber foam and are preferably encased in a thin, though tough, resilient covering of plastic material and then the peripheral edges covered by a plastic sewn-in-place binding, as is also conventional. The rigid guards 11 through 15 are connected to the softer, thicker and more resilient pads 21 through 25, respectively, by appropriate conventional rivets, such as rivets 31 through 35 securing the guards 11 through 15 to the pads 21 through 25, respectively, and stitching 41 through 45 likewise generally peripherally securing the guards 11 through 15 to the pads 21 through 25.

Figure 4:
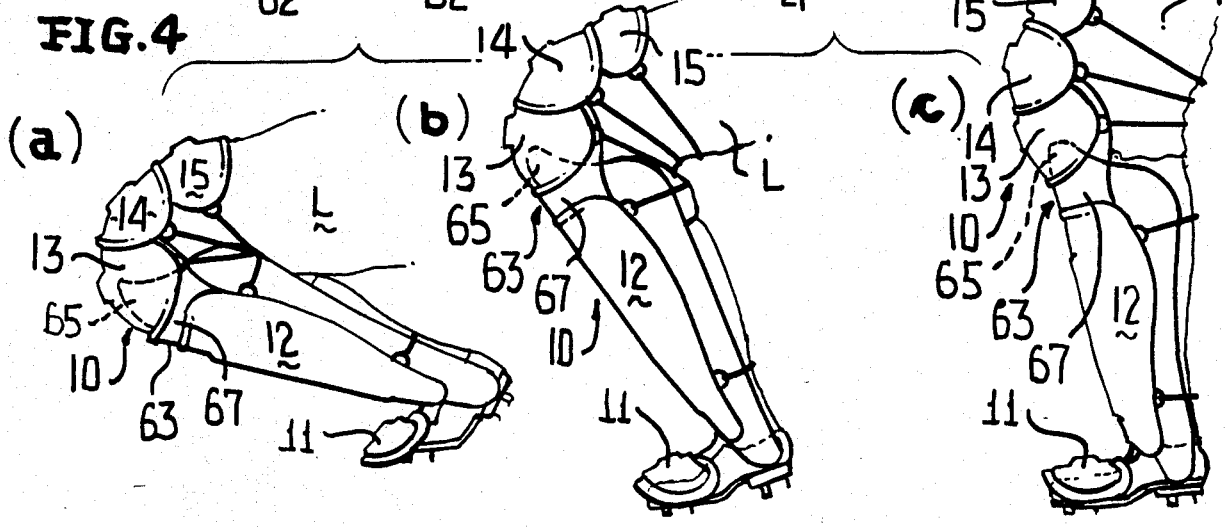
FIG. 4 is a schematic side elevational view of the protective leg guard, and illustrates in FIGS. 4(*a*) through (*c*) the manner in which the guards/pads are relatively articulated between "squat" and upright/standinglike positions.

A plurality of metallic loops 17 (FIG. 3) are connected to webs 18 of nylon or similar strap material which are sandwiched between the guards and pads 12, 22; 13, 23; 14, 24; and 15, 25, and are connected thereto by selected ones of the rivets 32, 33, 34 and 35. Similarly, two metallic loops 19 are similarly connected by nylon webs or straps 20 in sandwiched relationship between the guards and pads 12, 22; ;3, 23; 14, 24; and 15, 25 by selected ones of the rivets 32, 33, 34 and 35. Nylon/elastic straps 26 are looped through the double metallic rings 19 and carry hook fasteners 27 for connecting to the single loops 17 to securely and adjustably connect the protective leg guard 10 to a leg L (FIGS. 4(*a*) through (*c*)) of a baseball catcher or the like.

A single metallic loop 28 and two metallic loops 29 (FIGS. 1 and 3) are each connected to opposite ends (unnumbered) of a nylon web or strap 30 which is sandwiched between the shin guard 12 and the shin pad 22 and secured thereto by rivets 36. Essentially, one end of the strap 30 is looped through the ring 28, an opposite end of the strap 30 is looped through the double rings 29, and these ends are overlapped upon the portion of the strap 30 between the rings 28, 29 with a portion of the strap between the rivets 36, 36 being in generally chordal relationship to the arcuate or concave configuration of the shin guard 12. Therefore, should the shin guard 12 be struck by a ball or bat which might otherwise tend to flatten the concave curvature thereof, the chordal web or strap 30 resists this flattening and maintains the arcuate or curve configuration of the shin guard, particularly at the upper portion thereof which is most susceptible to distortion under impact because of its wider breadth.

The double loops 29 similarly carry an elastic strap 26 and fastener 27.

Means generally designated by the reference numeral 36 are provided for articulately connecting the toe plate 11 and its guard 21 to the shin plate 12 and its guard 22. The means 36 is simply a piece of foam padding having a plastic skin cover (unnumbered) and binding sewn along longitudinal edges thereof. The means 36, therefore, functions both to provide articulation and protection to the forward portion of the user's leg in the vicinity of the foot, ankle and lower shin. The means 36 is preferably sandwiched between the guards 11, 12 and the associated pads 21, 22 and connected thereat by the respective rivets 31, 32.

The shin guard 12 includes an overall peripheral edge (unnumbered) defined by an upper edge 37, a lower concave edge 35, and opposite generally convex side edges 39 which with the lower convex edge 38 cooperatively define lowermost radius portions 40 of the shin guard 12. A relatively shallow, inwardly projecting reinforcing rib 46 is positioned along the longitudinal center line of the shin guard 12 and similar short, generally rectangular, inwardly directed transverse ribs 48 are formed in pairs, one each on opposite sides of the rib 46. Four such ribs 48 are on each side of the longitudinal center line reinforcing rib 46.

Figure 2:
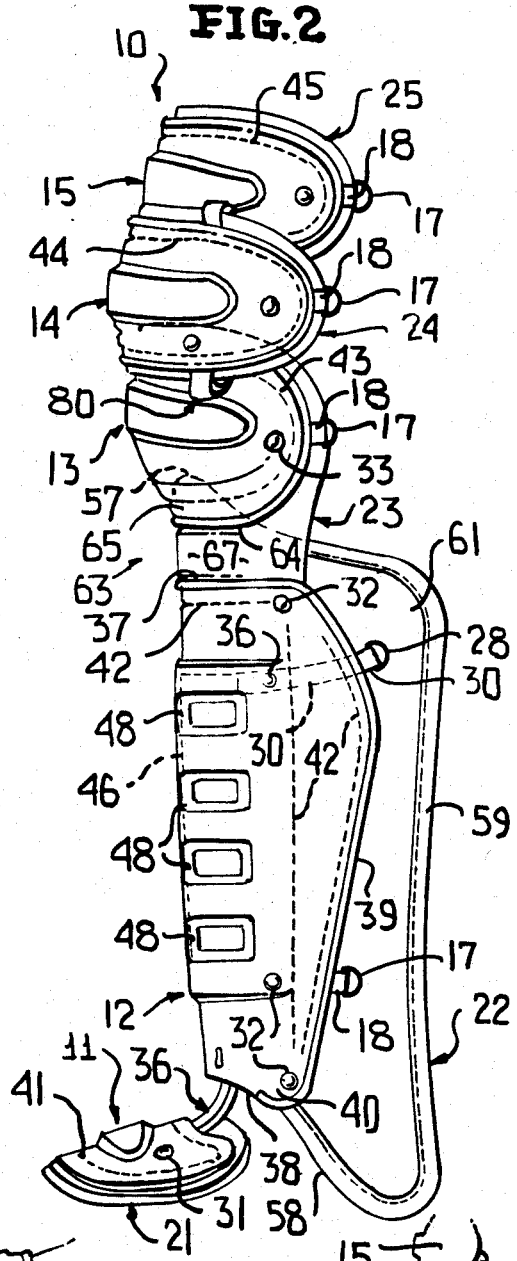
FIG. 2 is a side elevational view of the protective leg guard of FIG. 1, and illustrates various details thereof, including one of a pair of straps articulately interconnecting the second thigh guard/pad to the knee guard/pad and the associated second thigh guard/pad and an upper portion of the shin guard in spanning relationship to a gap between the shin guard upper edge and the knee guard.
Figure 5:
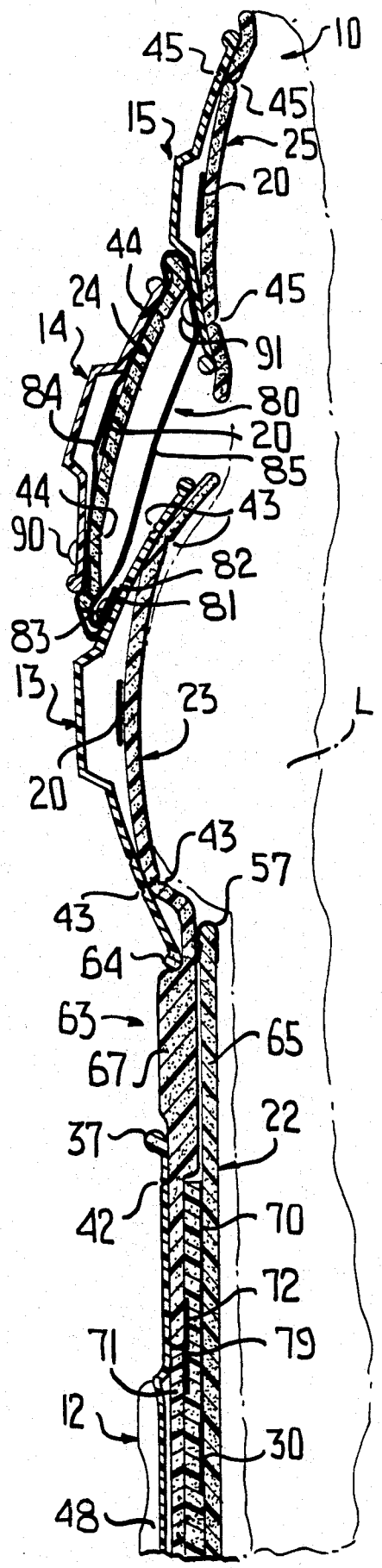
FIG. 5 is an enlarged fragmentary cross-sectional view taken generally along line 5—5 of FIG. 3, and illustrates details of the strap or web connecting the knee and thigh guards/pads and the separate piece of shock-absorbing material inserted between the shin guard and shin pad.

The shin pad 22 likewise includes a peripheral edge defined by an upper generally convex edge portion 57, a concavely opening lower edge portion 58, and opposite shallow, concavely curved side edges 59 which with the upper and lower edges or edge portions 57, 58 define respective upper calf protecting pad portions 61 and ankle protecting portions 62. Furthermore, the side edges 59 are each spaced appreciably rearwardly beyond the side edges 39 of the respective shin pad 22 and shin guard 12, as is best illustrated in FIG. 2 to provide optimum protection to the lateral or sides of the user's leg between ankle and knee. In addition, a gap 63 between the upper edge 37 of the shin guard 12 (FIG. 2) and a lower edge 64 of the knee guard 13 is effectively spanned by a knee-protecting pad portion 65 of the shin pad 22 whose uppermost portion is defined by the edge 57. Thus, the gap 63 between the knee guard 13 and the shin guard 12 is covered by two layers of padding or foam material, as is best illustrated in FIG. 5, namely, the knee-protecting pad portion 65 of the shin pad 22 and a relatively thick portion 67 (FIG. 5) of the knee pad 23 exposed between the edge 37 of the shin guard 12 and the lower edge 64 of the knee guard 13.

Two pieces of foam padding 70, 71 (FIG. 5) are secured to each other in partially overlapped relationship (FIG. 5) by a strip of double-backed adhesive 72 which is also secured to the lowermost edge 79 of the knee pad 23 which is sandwiched between the shock-absorbing material 70 and the shin guard 12. The pieces of shock-absorbing material 70, 71 are also sandwiched between the shin guard 12 and the chordal strap 30 which in turn passes between the piece of shock-absorbing material 70 and the shin pad 22 (FIG. 5). Accordingly, the upper central portion of the shin guard 12 is provided with optimum padding/shock-absorbing material which together with the chordal strap 30 assures maximum protection to the upper shin/knee area of the user.

Figure 3:
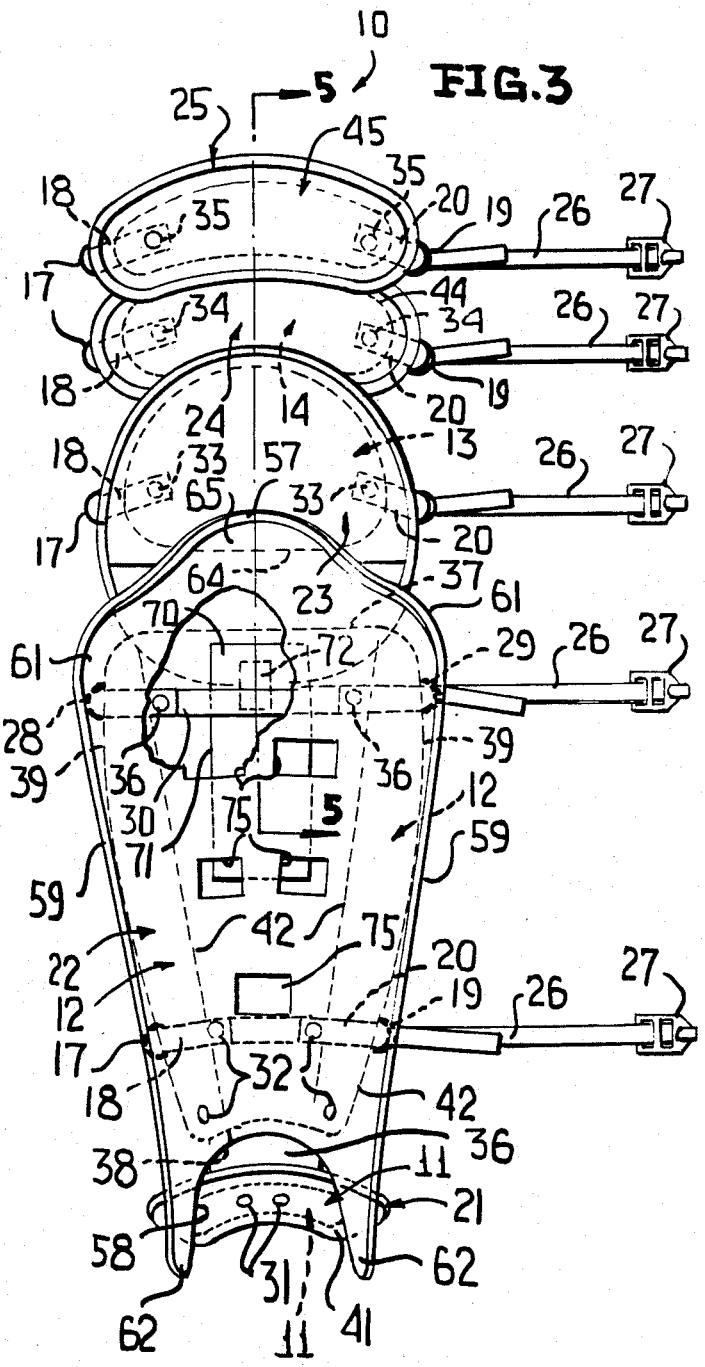
FIG. 3 is a rear elevational view of the protective leg guard with a portion of the shin pad broken away for clarity, and illustrates the various pads and shock absorbing material sandwiched between the shin pad and the shin guard.

Five generally rectangular ventilation openings 75 are formed in the shin pad 22, as is best illustrated in FIG. 3.

It is also to be noted that the knee pad 23 functions not only as protection, but also serves as the articulation, joining or pivoting means between the shin guard 12 and the knee guard 13 by means of the flexible nature of the material and the fact that the same is connected to the shin guard 12 by the uppermost pair of rivets 32.

Means 80 (FIGS. 1, 2 and 5) functions as the means for articulating joining or pivoting the first thigh guard 14 and its pad 24 to and between the second thigh guard 15 and the knee guard 13 along with the associated second thigh pad 25 and knee pad 23. The means are a pair of nylon webs or straps 80 formed in a continuous loop (See FIG. 5) having overlapped ends 81, 82 secured by a rivet 83 to the knee guard 13. One portion 84 of each web or strap 80 is sandwiched between the first thigh guard 14 and the first thigh pad 24 and is secured thereto by the stitching 44 and rivets 90. Another portion 85 of each web or strap 80 is in part sandwiched between the second thigh guard 15 and the first thigh pad 24, and this sandwiched portion is connected to the first thigh guard 15 by a rivet 91 and the stitching 45. Thus, each web or strap 80 is connected by rivets 83, 90 and 91 to the respective guards 13, 14 and 15, and is additionally secured to the same guards and the associated pads thereof by the respective stitching 43, 44 and 45. In this manner the first thigh guard 14 and its associated pad 24 is held stable, though articulately movable in overlapped relationship to both the guards 13, 15 and the associated pads 23, 25. This permits the user to assume any one of a plurality of positions (FIGS. 4(*a*) through 4(*c*)) from squatting to/through intermediate and to/through upright, respectively. In all of the latter positions and beyond or between, the guards and associated pads 13 through 15 and 23 through 25 fully cover and protect all areas of the user's knee and thigh, as is most apparent from FIG. 4 of the drawings.

Although in a preferred embodiment of the invention as has been specifically illustrated and described herein, it is to be understood that minor variations may be made in the apparatus without departing from the spirit and scope of the invention, as defined in the amended claims.

I claim:

1. A protective leg guard comprising a relatively rigid foot guard, shin guard, knee guard and first and second thigh guards; means for pivotally connecting said shin guard to and between said foot and knee guards, a relatively thick resilient protective foot pad, shin pad and knee pad; means for joining said protective foot, shin and knee pads to said respective foot, shin and knee guards; said shin guard having a peripheral edge defined by an upper edge, a lower concave edge and opposite convex side edges; said shin pad having a peripheral edge defined by an upper edge, a lower concave edge and opposite side edges; each shin pad side edge merging with said shin pad lower concave edge at a lowermost convex radius edge and setting-off therewith an ankle bone protective pad portion of each shin pad projecting appreciably downwardly beyond said shin guard lower edge; each shin pad side edge merging with said shin pad upper edge at an uppermost convex radius edge and setting-off therewith an upper calf protective pad portion of each shin pad projecting appreciably rearwardly beyond the associated shin guard side edges; and said shin pad side edges project rearwardly appreciably beyond said shin guard side edges to set-off therewith relatively rearwardly broad and long inner and outer calf protective pad portions of said shin pad.

2. The protective leg guard as defined in claim 1 wherein said shin pad side edges are of a shallow concave configuration.

3. The protective leg guard as defined in claim 1 including a piece of shock-absorbing material sandwiched between said shin guard and shin pad.

4. The protective leg guard as defined in claim 1 including a relatively narrow piece of shock-absorbing material sandwiched between said shin guard and shin pad in appreciably spaced relationship to said shin guard lower edge and in generally adjacent relationship to said shin guard upper edge.

5. The protective leg guard as defined in claim 1 including a piece of shock-absorbing material sandwiched between said shin guard and shin pad in appreciably spaced relationship to said shin guard lower edge and in generally adjacent relationship to said shin guard upper edge.

6. The protective leg guard as defined in claim 1 wherein said shin pad upper edge is of a generally convex configuration and defines a knee protective pad portion of said shin pad projecting appreciably upwardly beyond said shin guard upper edge.

7. The protective leg guard as defined in claim 1 wherein said shin pad upper edge is of a generally convex configuration and defines a knee protective pad portion of said shin pad projecting appreciably upwardly beyond said shin guard upper edge, said pivotal connecting means includes a shin-to-knee guard pivot pad, and said knee protective pad portion of said shin pad is in overlying relationship to said shin-to-knee guard pivot.

8. The protective leg guard as defined in claim 1 wherein said shin pad upper edge is of a generally convex configuration and defines a knee protective pad portion of said shin pad projecting appreciably upwardly beyond said shin guard upper edge, said pivotal connecting means includes a shin-to-knee guard pivot pad, and said knee protective pad portion of said shin pad is in overlying relationship to said shin-to-knee guard pivot and in generally spanning relationship between said knee and shin guards.

9. The protective leg guard as defined in claim 1 wherein said shin pad upper edge is of a generally convex configuration and defines a knee protective pad portion of said shin pad projecting appreciably upwardly beyond said shin guard upper edge, said pivotal connecting means includes a shin-to-knee guard pivot pad, said knee protective pad portion of said shin pad is in overlying relationship to said shin-to-knee guard pivot, and in generally spanning relationship between a gap between said shin guard upper edge and a lower edge of said knee guard.

10. A protective leg guard comprising a relatively rigid foot guard, shin guard, knee guard and first and second thigh guards; means for pivotally connecting said guards together in the latter-recited order; a relatively thick resilient protective foot pad, shin pad, knee pad and first and second thigh pads; means for joining said protective foot, shin, knee, first and second pads to said respective foot, shin, knee, first and second guards; and said first thigh guard being in overlapping relationship to said knee and second thigh guards.

11. The protective leg guard as defined in claim 10 wherein said first thigh guard is in overlapping relationship to the same side of said knee and second thigh guards.

12. The protective leg guard as defined in claim 10 wherein said first thigh guard is in overlapping relationship to a front side of both said knee and second thigh guards.

13. The protective leg guard as defined in claim 10 wherein said pivot-connecting means includes a common pivot member connecting said knee guard to both of said first and second thigh guards.

14. The protective leg guard as defined in claim 10 wherein said pivot connecting means includes a common pivot member connecting said knee guard to both of said first and second thigh guards, and said common pivot member is a flexible web.

15. The protective leg guard as defined in claim 10 wherein each of said knee, first thigh and second thigh guards are relatively shallow cups having inner and outer surfaces and respective upper and lower convex edges, and said first thigh guard upper and lower edges are in overlapped relationship to said knee and second thigh guard outer surfaces adjacent said respective upper and lower edges thereof.

16. The protective leg guard as defined in claim 10 wherein said pivot connecting means includes a common pivot member connecting said knee guard to both of said first and second thigh guards, and said common pivot member is a flexible web at least in part sandwiched between said first thigh guard and first thigh pad.

17. The protective leg guard as defined in claim 10 wherein said pivot connecting means includes a common pivot member connecting said knee guard to both of said first and second thigh guards, said common pivot member is a flexible web, and rivets connecting said flexible web to each of said knee, first thigh and second thigh guards.

18. The protective leg guard as defined in claim 10 wherein said pivot connecting means includes a common pivot member connecting said knee guard to both of said first and second thigh guards, and said common pivot member is a flexible web in encircling relationship to said first thigh pad.

19. The protective leg guard as defined in claim 10 wherein said pivot connecting means includes a common pivot member connecting said knee guard to both of said first and second thigh guards, said common pivot member is a flexible web in encircling relationship to said first thigh pad, and in part in sandwiched relationship between said first thigh pad and first thigh guard.

20. The protective leg guard as defined in claim 10 wherein said pivot connecting means includes a common pivot member connecting said knee guard to both of said first and second thigh guards, said common pivot member is a flexible web, and means for connecting said flexible web to each of said knee, first thigh and second thigh guards.

21. The protective leg guard as defined in claim 10 wherein said pivot connecting means includes a common pivot member connecting said knee guard to both of said first and second thigh guards, said common pivot member is a flexible web, means for connecting said flexible web to each of said knee, first thigh and second thigh guards, and said web-connecting means includes a rivet.

22. The protective leg guard as defined in claim 10 wherein said pivot connecting means includes a common pivot member connecting said knee guard to both of said first and second thigh guards, said common pivot member is a flexible web, means for connecting said flexible web to each of said knee, first thigh and second thigh guards, and said web-connecting means includes stitching between said first thigh pad and guard and through said web.

23. The protective leg guard as defined in claim 10 wherein said pivot connecting means includes a common pivot member connecting said knee guard to both of said first and second thigh guards, said common pivot member is a flexible web, means for connecting said flexible web to each of said knee, first thigh and second thigh guards, and said web-connecting means includes rivets between said web and each of said knee, first thigh and second thigh guards.

24. The protective leg guard as defined in claim 12 wherein said pivot connecting means includes a common pivot member connecting said knee guard to both of said first and second thigh guards.

25. The protective leg guard as defined in claim 12 wherein said pivot connecting means includes a common pivot member connecting said knee guard to both of said first and second thigh guards, and said common pivot member is a flexible web.

26. The protective leg guard as defined in claim 12 wherein said pivot connecting means includes a common pivot member connecting said knee guard to both of said first and second thigh guards, and said common pivot member is a flexible web at least in part sandwiched between said first thigh guard and first thigh pad.

27. The protective leg guard as defined in claim 12 wherein said pivot connecting means includes a common pivot member connecting said knee guard to both of said first and second thigh guards, and said common pivot member is a flexible web in encircling relationship to said first thigh pad.

28. The protective leg guard as defined in claim 12 wherein said pivot connecting means includes a common pivot member connecting said knee guard to both of said first and second thigh guards, said common pivot member is a flexible web in encircling relationship to said first thigh pad, and in part in sandwiched relationship between said first thigh pad and first thigh pad.

29. The protective leg guard as defined in claim 12 wherein said pivot connecting means includes a common pivot member connecting said knee guard to both of said first and second thigh guards, said common pivot member is a flexible web, and means for connecting said flexible web to each of said knee, first thigh and second thigh guards.

30. A protective leg guard comprising a relatively rigid shin guard and knee guard first and second thigh guards; means for pivotally connecting said guards to each other; said shin and knee guards having respective upper and lower edges; a relatively thick resilient protective shin pad and knee pad carried by said respective shin and knee guards; said pivotal connecting means spanning a gap between said shin guard upper edge and said knee guard lower edge; and said shin pad having a knee protecting portion projecting beyond said shin guard upper edge into at least partial overlying relationship to said gap thereby effectively protecting a wearer's shin/knee in the area of said gap.

31. The protective leg guard as defined in claim 30 wherein said pivotal connecting means is an extension of said knee pad whereby a wearer's shin/knee in the area of said gap is protected by overlaped areas of said knee pad extension and said knee protecting portion.

32. The protective leg guard as defined in claim 30 including a piece of shock-absorbing material carried by said shin guard in at least partial sandwiched relationship between said shin pad and said knee pad extension.

33. The protective leg guard as defined in claim 30 including a piece of shock-absorbing material carried by said shin guard in at least partial sandwiched relationship between said shin pad knee protecting portion and said knee pad extension.

34. The protective leg guard as defined in claim 31 including a piece of shock-absorbing material carried by said shin guard in at least partial sandwiched relationship between said shin pad and said knee pad extension.

35. A protective leg guard comprising a rigid shin guard carrying a relatively resilient protective shin pad; said shin guard having upper, lower and opposite side edges; said side edges in-part setting-off lateral calf-guarding portions of said shin guard on opposite sides of a shin-guarding portion therebetween; said shin guard side edges each being of a generally convex configuration defined by a medial convex edge portion between upper and lower side edge portions; said medial convex edge portion being located more closely adjacent to said shin guard upper edge than to said shin guard lower edge and setting-off the maximum lateral projecting length of said lateral calf-guarding portions; each upper and lower side edge portion merging with said upper and lower edges at respective upper and lower convex radius edges; said shin pad having upper, lower and opposite side edges corresponding in location to said shin guard respective upper, lower and opposite side edges; each shin pad side edge being joined to said shin pad upper and lower edges by respective, upper and lower convex radius edges; said shin pad upper edges and convex radius edges being of a relatively larger length and radius respectively than said shin guard upper edges and convex radius edges thereby defining upper inner and outer upper-calf protective portions of said shin pad; and said shin pad side edges each being appreciably spaced from said shin guard side edges thereby defining relatively laterally wide medial-calf and lower-calf protective portions of said shin pad.

36. The protective leg guard as defined in claim 35 wherein each said lower-calf protective portion merges with a lateral-ankle protective portion of said shin pad, a rigid front foot guard and relatively resilient-protective front foot pad between said lateral-ankle protective portions, means for pivotally connecting said front foot guard to said shin guard; and said lateral-ankle protective portions project sufficiently toward said front foot guard to protect inner and outer ankle bones of a wearer of the protective leg guard.

37. The protective leg guard as defined in claim 36 wherein said shin pad side edges are each relatively straight.

38. The protective leg guard as defined in claim 36 wherein said shin pad side edges are each of a relatively shallow concavely curved configuration.

* * * * *